US012678850B2

(12) United States Patent
Yamauchi et al.

(10) Patent No.: US 12,678,850 B2
(45) Date of Patent: Jul. 14, 2026

(54) MOLDING DEVICE

(71) Applicant: SUMITOMO HEAVY INDUSTRIES, LTD., Tokyo (JP)

(72) Inventors: Kei Yamauchi, Niihama (JP); Eiji Kouyama, Niihama (JP); Hiroyuki Kan, Niihama (JP); Norieda Ueno, Niihama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 252 days.

(21) Appl. No.: 18/412,925

(22) Filed: Jan. 15, 2024

(65) Prior Publication Data

US 2024/0149323 A1 May 9, 2024

Related U.S. Application Data

(63) Continuation of application No. PCT/JP2022/021249, filed on May 24, 2022.

(30) Foreign Application Priority Data

Sep. 17, 2021 (JP) ..... 2021-152045

(51) Int. Cl.
*B21D 26/041* (2011.01)
*B21D 26/039* (2011.01)

(52) U.S. Cl.
CPC ..... *B21D 26/041* (2013.01); *B21D 26/039* (2013.01)

(58) Field of Classification Search
CPC .. B21D 26/033; B21D 26/039; B21D 26/041; B21D 26/047; B21D 26/025
USPC ..... 72/21.4
See application file for complete search history.

(56) References Cited

U.S. PATENT DOCUMENTS 4,167,388 A 9/1979 Keelor et al.
4,703,644 A * 11/1987 Waldner ..... B21J 15/24 83/575
5,233,854 A * 8/1993 Bowman ..... B21D 26/039 72/58
5,233,856 A * 8/1993 Shimanovski ..... B21D 39/203 72/62
5,372,027 A 12/1994 Roper et al.
5,533,372 A 7/1996 Roper et al.
6,006,567 A 12/1999 Brown et al.
6,298,701 B1 * 10/2001 Marando ..... B30B 1/26 72/58
6,322,645 B1 11/2001 Dykstra et al.
6,502,822 B1 * 1/2003 Brown ..... B21D 26/045 72/58

(Continued)

FOREIGN PATENT DOCUMENTS

CN 1 07000023 A 8/2017
CN 107405671 A 11/2017

(Continued)

OTHER PUBLICATIONS

Office Action of JP Application No. 2023-548123 Mailed on Sep. 24, 2025.

(Continued)

*Primary Examiner* — Edward T Tolan
(74) *Attorney, Agent, or Firm* — WTA IP Law P.C.

(57) ABSTRACT

A molding device supplies a fluid and performs expansion molding of a metal material using at least a part of members of an existing press device.

9 Claims, 12 Drawing Sheets

(56) References Cited

U.S. PATENT DOCUMENTS

| | | | | |
|---|---|---|---|---|
| 6,530,252 | B1 * | 3/2003 | Hashimoto | B21D 26/039 72/58 |
| 7,124,618 | B1 * | 10/2006 | Ghiran | B21D 26/039 72/63 |
| 8,408,034 | B2 * | 4/2013 | Ishihara | B21D 37/16 72/58 |
| 11,975,376 | B2 * | 5/2024 | Pan | B21D 26/025 |
| 2001/0005929 | A1 | 7/2001 | Streubel et al. | |
| 2007/0261457 | A1 * | 11/2007 | Witschas | B21B 31/00 72/239 |
| 2017/0266710 | A1 | 9/2017 | Ishizuka et al. | |
| 2018/0221933 | A1 | 8/2018 | Saika et al. | |
| 2021/0101199 | A1 | 4/2021 | Saika et al. | |

FOREIGN PATENT DOCUMENTS

| | | | |
|---|---|---|---|
| CN | 107921511 | A | 4/2018 |
| DE | 196 03 351 | A1 | 8/1997 |
| JP | H9-314240 | A | 12/1997 |
| JP | 3012117 | B2 | 12/1999 |
| JP | 2001 087821 | A | 4/2001 |
| JP | 2004-276075 | A | 10/2004 |
| JP | 2005-144549 | A | 6/2005 |
| JP | 4082743 | B2 | 2/2008 |
| JP | 2013-188793 | A | 9/2013 |
| JP | 2020-151754 | A | 9/2020 |

OTHER PUBLICATIONS

European Search Report of EP Application No. 22869637.3 Mailed on Dec. 4, 2024.

International Search Report of PCT/JP2022/021249 Mailed on Jul. 12, 2022.

Office Action of the corresponding CN Application No. 202280040287.3 Mailed on Feb. 26, 2026.

* cited by examiner

MOLDING DEVICE

CROSS-REFERENCE TO RELATED APPLICATIONS

This is a bypass continuation of International PCT Application No. PCT/JP2022/021249, filed on May 24, 2022, which claims priority to Japanese Patent Application No. 2021-152045, filed on Sep. 17, 2021, which are incorporated by reference herein in their entirety.

BACKGROUND

Technical Field

A certain embodiment of the present disclosure relates to a molding device.

Description of Related Art

In the related art, a device described in the related art is known as a molding device that molds a metal material. The molding device molds a plate-shaped member into a component having a desired shape by pressing the member.

SUMMARY

According to an aspect of the present disclosure, there is provided a molding device that supplies a fluid to perform expansion molding of a metal material using at least a part of members of an existing press device.

DETAILED DESCRIPTION

Herein, it is required to reduce introduction costs of the molding device that supplies a fluid to perform expansion molding of a metal material.

According to an embodiment of the present disclosure, it is desirable to provide a molding device that can reduce introduction costs.

With this, the molding device that supplies a fluid to perform expansion molding of the metal material can be configured by utilizing a part of the members of the existing press device. Accordingly, introduction costs of the molding device can be reduced.

The fluid may be a gas.

The molding device may perform expansion molding of a heated metal material.

The part of the members may be a foundation. In this case, costs of foundation work can be omitted by utilizing the foundation of the existing press device.

A peripheral device in the molding device may be provided with the foundation as reference. In this case, layout can effectively use the foundation of the existing press device.

The part of the members may be a high-pressure air generating device. In this case, capital investment in the high-pressure air generating device can be suppressed.

The part of the members may be a hydraulic unit. In this case, the hydraulic unit of the existing press device may be utilized, and a machine portion may be updated. Physical dimensional requirements of the existing press device required for the molding device are not satisfied, but this utilization mode is adoptable when the hydraulic unit has a control function of the molding device. Accordingly, investment in the hydraulic unit portion of the molding device can be suppressed.

The part of the members may be at least one press component of a main cylinder, a bed, a crown, and a slide. In this case, the machine portion of the existing press device may be utilized, and a hydraulic pressure control portion or the like may be updated. Although the physical dimensional requirements of the existing press device required for the molding device are satisfied, this utilization mode is adoptable when the hydraulic pressure cannot be controlled. Accordingly, investment in the machine portion of the molding device can be suppressed.

Hereinafter, a preferred embodiment of the present disclosure will be described with reference to the drawings. In each drawing, the same reference signs will be assigned to the same portions or equivalent portions, and redundant description thereof will be omitted.

Figure 1:
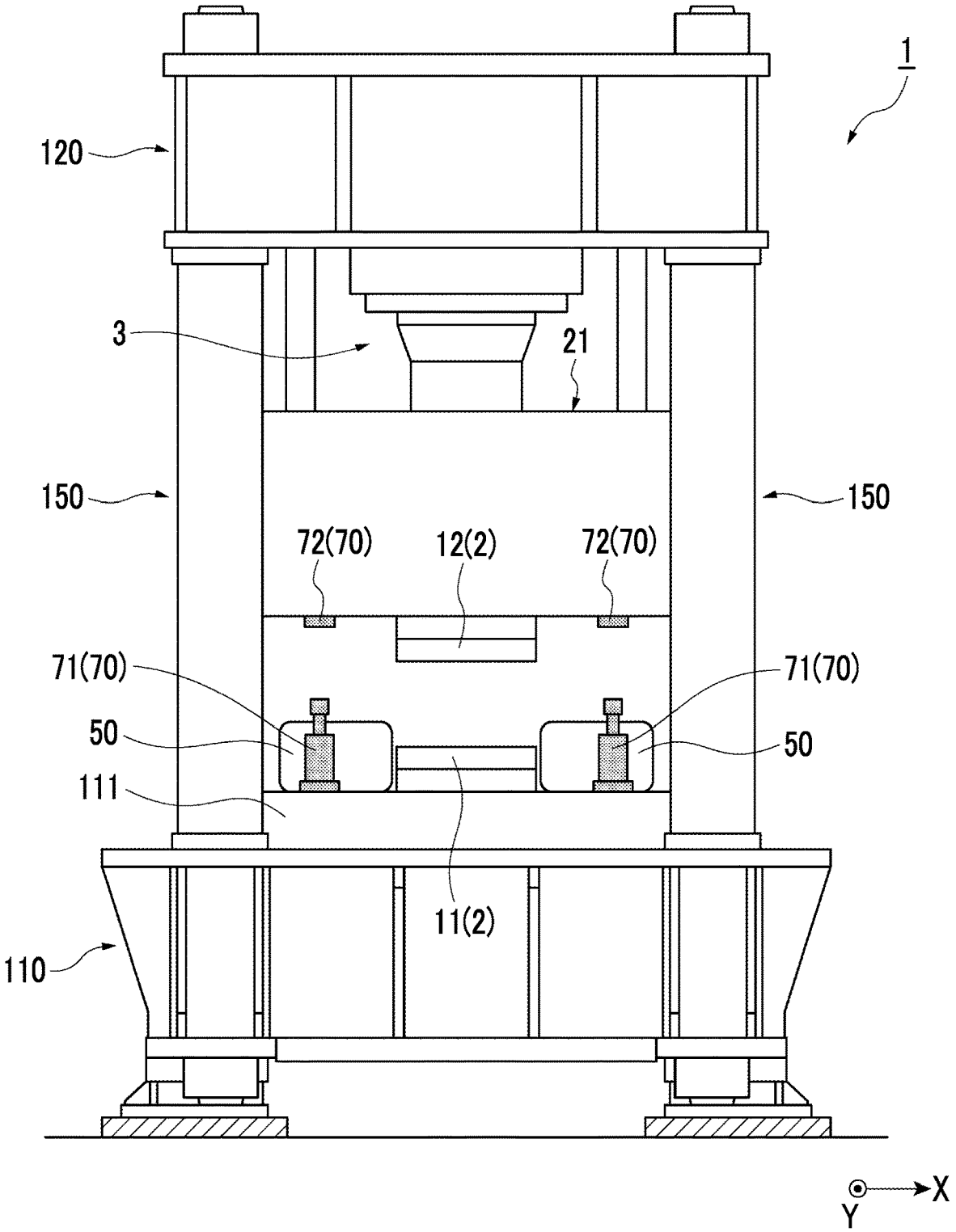
FIG. 1 is a front view of a molding device according to the present embodiment.

FIG. 1 is a front view of a molding device according to the present embodiment. As shown in FIG. 1, a molding device 1 includes a die 2, a lower base portion 110, an upper base portion 120, and a pillar portion 150. The die 2 includes an upper die 12 (first die) and a lower die 11 (second die). The lower base portion 110 faces the lower die 11 and is provided on a lower side thereof. One direction in a horizontal direction will be referred to as an X-axis direction and a direction perpendicular to the X-axis direction in the horizontal direction will be referred to as a Y-axis direction. One side (a right side of a paper surface in FIG. 1) in the X-axis direction will be referred to as a positive side, and one side (a front side of the paper surface in FIG. 1) in the Y-axis direction will be referred to as a positive side.

The lower base portion 110 is a component called bed and configures a base of the molding device 1. In the lower base portion 110, a drive mechanism or the like that moves the lower die 11 may be accommodated, or the lower die 11 may be configured to be immovable. The lower base portion 110 has a rectangular parallelepiped shape. The lower base portion 110 has a plate-shaped base stage 111 (a disposition portion for the second die) on an upper end side thereof. On the base stage 111, the lower die 11 and a heating and expanding unit 50 to be described later are disposed. An upper surface of the base stage 111 corresponds to an upper surface of the lower base portion 110. The lower die 11 is attached to the base stage 111 via a die holder or the like.

The upper base portion 120 faces the upper die 12 and is provided on an upper side thereof. The upper base portion 120 is a component called crown and is a component which is a base for an upper structure of the molding device 1. In the upper base portion 120, a drive mechanism 3 or the like which moves the upper die 12 is accommodated. The upper die 12 is attached to a slide 21 (a disposition portion for the first die) via a die holder or the like. The upper base portion 120 has a rectangular parallelepiped shape (or a trapezoidal shape). The pillar portion 150 is a member provided to stand between the lower base portion 110 and the upper base portion 120. A plurality of (herein, four) pillar portions 150 are formed to surround the periphery of the die 2. A detailed configuration of the pillar portions 150 will be described later.

The molding device 1 according to the present embodiment includes a load receiving mechanism 70 that receives a load to stop a die closing operation during die closing of the upper die 12 and the lower die 11. In the example shown in FIG. 1, in total four load receiving mechanisms 70 are provided at positions on both sides of the die 2 in the X-axis direction and positions on both sides of the heating and expanding unit 50 in the Y-axis direction. That is, the load receiving mechanisms 70 are provided at positions different from that of the die 2 in an XY direction. The load receiving mechanisms 70 each include a load receiving member 71 and a contact member 72. The load receiving member 71 is provided on the upper surface of the base stage 111. The contact member 72 is a member that comes into contact with the load receiving member 71. The contact member 72 is provided on a lower surface of the slide 21. On the upper side of the load receiving member 71, the contact member 72 is provided at a position facing the load receiving member 71. A detailed configuration of the load receiving mechanisms 70 will be described later.

Figure 2:
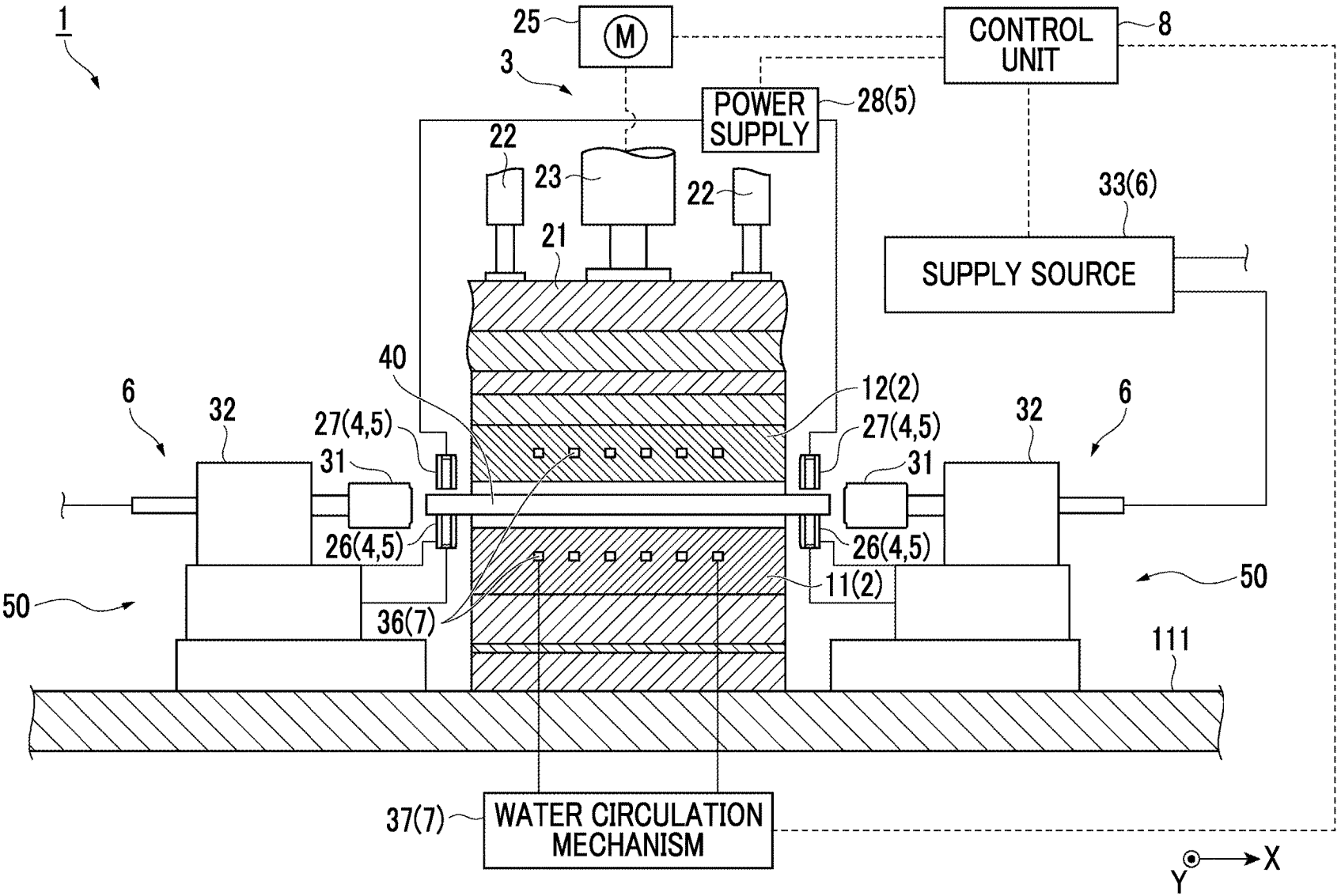
FIG. 2 is a schematic view of the molding device according to the present embodiment.

Next, functions or the like of the molding device 1 will be described in further detail. FIG. 2 is a schematic view of the molding device 1 according to the present embodiment (however, the load receiving mechanism 70 of FIG. 1 is omitted). As shown in FIG. 2, the molding device 1 is a device that molds a metal pipe material having a closed section through expansion molding. In the present embodiment, the molding device 1 is provided on a horizontal plane. The molding device 1 includes the die 2 described above, the drive mechanism 3, a holding unit 4, a heating unit 5, a fluid supply unit 6, a cooling unit 7, and a control unit 8. In the present specification, a metal pipe refers to a hollow article after completion of molding in the molding device 1, and a metal pipe material 40 refers to a hollow article before completion of molding in the molding device 1. The metal pipe material 40 is a steel-type pipe material that can be hardened.

The drive mechanism 3 is a mechanism that moves at least one of the lower die 11 and the upper die 12. In FIG. 2, the drive mechanism 3 has a configuration of moving only the upper die 12. The drive mechanism 3 includes the slide 21 that moves the upper die 12 such that the lower die 11 and the upper die 12 are joined together, a pull-back cylinder 22 that is an actuator which generates a force of pulling the slide 21 upward, a main cylinder 23 that is a drive source which downward-pressurizes the slide 21, and a drive source 25 that applies a driving force to the main cylinder 23.

The holding unit 4 is a mechanism that holds the metal pipe material 40 disposed between the lower die 11 and the upper die 12. The holding unit 4 includes a lower electrode 26 and an upper electrode 27 that hold the metal pipe material 40 on one end side in an extending direction of the die 2, and a lower electrode 26 and an upper electrode 27 that hold the metal pipe material 40 on the other end side in the extending direction of the die 2. The lower electrodes 26 and the upper electrodes 27 on both sides in the extending direction hold the metal pipe material 40 with vicinities of end portions of the metal pipe material 40 sandwiched therebetween from an up-down direction. Groove portions having a shape corresponding to an outer peripheral surface of the metal pipe material 40 are formed in upper surfaces of the lower electrodes 26 and lower surfaces of the upper electrodes 27. The lower electrode 26 and the upper electrode 27 can be moved independently of each other in the up-down direction by a drive mechanism of the heating and expanding unit 50.

The heating unit 5 heats the metal pipe material 40. The heating unit 5 is a mechanism that heats the metal pipe material 40 by energizing the metal pipe material 40. The heating unit 5 heats the metal pipe material 40 in a state where the metal pipe material 40 is separated apart from the lower die 11 and the upper die 12 between the lower die 11 and the upper die 12. The heating unit 5 includes the lower electrodes 26 and the upper electrodes 27 on both sides in the extending direction described above and a power supply 28 that causes a current to flow through the metal pipe material via the electrodes 26 and 27. The heating unit 5 may be disposed in a preceding process of the molding device 1 and may perform heating externally.

The fluid supply unit 6 is a mechanism for supplying a high-pressure fluid into the metal pipe material 40 held between the lower die 11 and the upper die 12. The fluid supply unit 6 supplies the high-pressure fluid into the metal pipe material 40 that has been brought into a high-temperature state by being heated by the heating unit 5 and expands the metal pipe material 40. The fluid supply units 6 are provided on both end sides of the die 2 in the extending direction. The fluid supply units 6 each include a nozzle 31 that supplies a fluid from opening portions of the end portions of the metal pipe material 40 to an inside of the metal pipe material 40, a drive mechanism 32 that moves the nozzle 31 back and forth with respect to the opening portions of the metal pipe material 40, and a supply source 33 that supplies the high-pressure fluid into the metal pipe material 40 via the nozzle 31. The drive mechanism 32 brings the nozzle 31 into close contact with the end portion of the metal pipe material 40 in a state where a sealing property is secured during supply and exhaust of the fluid (see FIG. 3B) and separates the nozzle 31 from the end portion of the metal pipe material 40 at other times. The fluid supply unit 6 may supply a gas such as high-pressure air and an inert gas as the fluid. In addition, the fluid supply unit 6 may be the same device including the holding unit 4 that includes a mechanism which moves the metal pipe material 40 in the up-down direction and the heating unit 5.

Figure 3A:
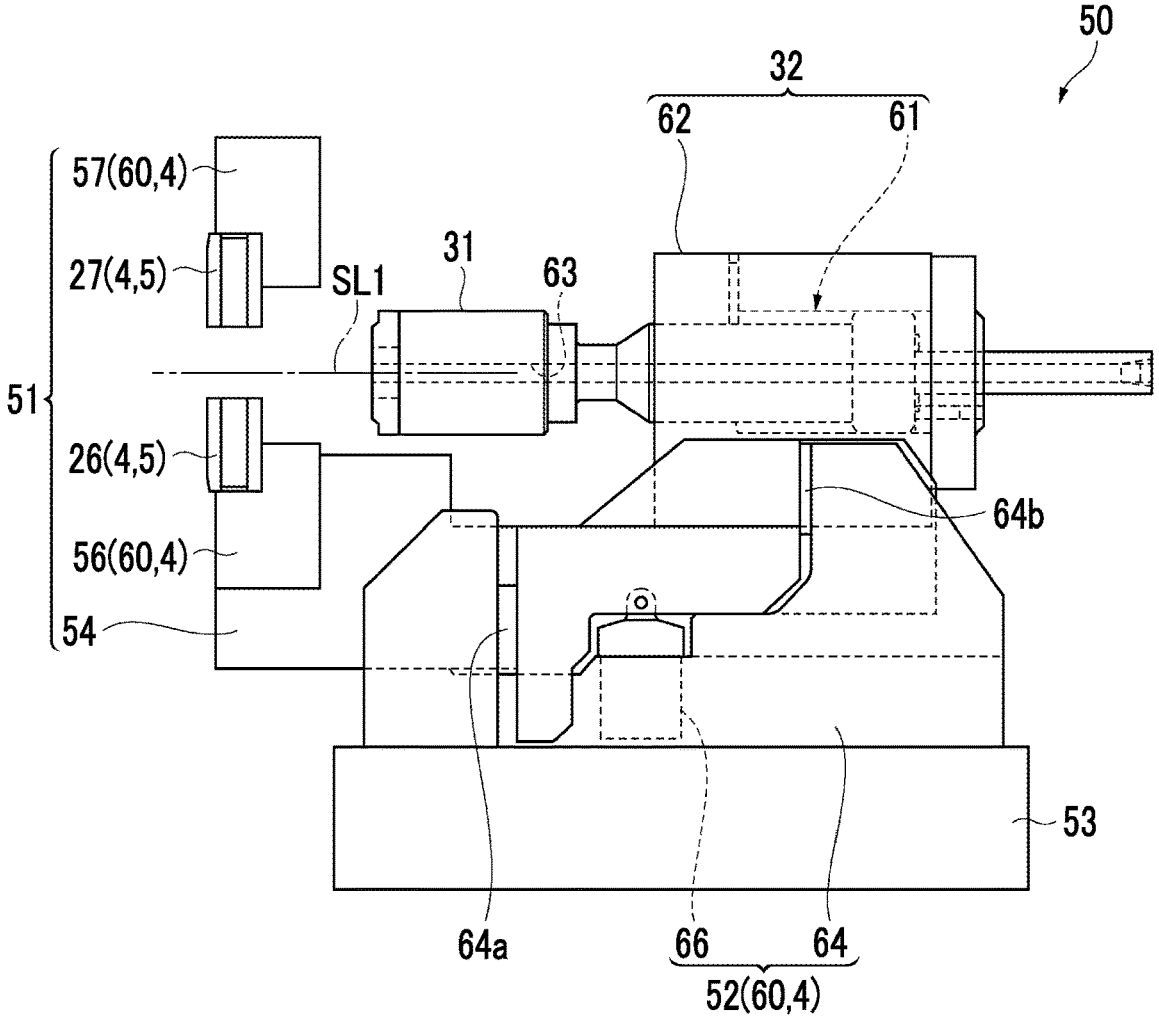
FIG. 3A is a view showing a heating and expanding unit.
Figure 3B:
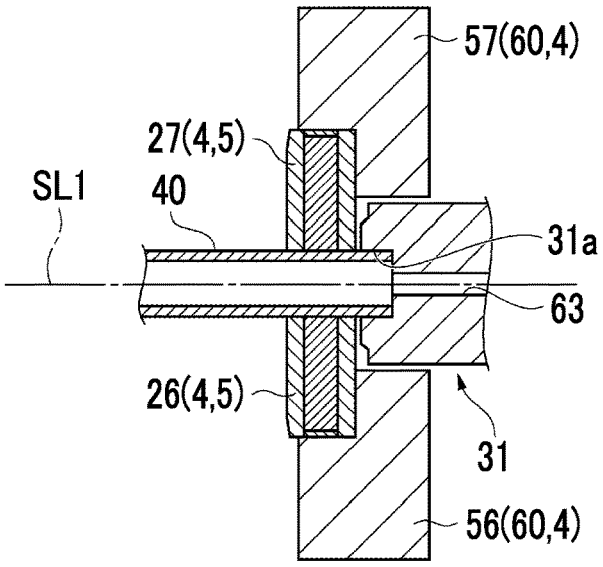
FIG. 3B is an enlarged view of a nozzle.

FIG. 3A is a schematic side view showing the heating and expanding unit 50 in which components of the holding unit 4, the heating unit 5, and the fluid supply unit 6 are unitized. FIG. 3B is a sectional view showing a state where the nozzle 31 has sealed the metal pipe material 40.

As shown in FIG. 3A, the heating and expanding unit 50 includes the lower electrodes 26 and upper electrodes 27, which are described above, an electrode mounting unit 51 on which the electrodes 26 and 27 are mounted, the nozzle 31 and the drive mechanism 32, which are described above, a lifting and lowering unit 52, and a unit base 53. The electrode mounting unit 51 includes a lifting and lowering frame 54 and electrode frames 56 and 57. The electrode frames 56 and 57 function as a part of a drive mechanism 60 that supports and moves each of the electrodes 26 and 27. The drive mechanism 32 drives the nozzle 31 and lifts and lowers together with the electrode mounting unit 51. The drive mechanism 32 includes a piston 61 that holds the nozzle 31 and a cylinder 62 that drives the piston. The lifting and lowering unit 52 includes a lifting and lowering frame base 64 that is attached to an upper surface of the unit base 53 and a lifting and lowering actuator 66 that applies a lifting and lowering operation to the lifting and lowering frame 54 of the electrode mounting unit 51 by the lifting and lowering frame base 64. The lifting and lowering frame base 64 includes guide portions 64*a* and 64*b* that guide the lifting and lowering operation of the lifting and lowering frame 54 with respect to the unit base 53. The lifting and lowering unit 52 functions as a part of the drive mechanism 60 of the holding unit 4. The heating and expanding unit 50 includes a plurality of unit bases 53 of which upper surfaces have different inclination angles and is allowed to collectively change and adjust inclination angles of the lower electrode 26, the upper electrode 27, the nozzle 31, the electrode mounting unit 51, the drive mechanism 32, and the lifting and lowering unit 52 by replacing the unit bases 53.

The nozzle 31 is a cylindrical member into which the end portion of the metal pipe material 40 can be inserted. The nozzle 31 is supported by the drive mechanism 32 such that a center line of the nozzle 31 matches a reference line SL1. An inner diameter of a feed port 31*a* at an end portion of the nozzle 31 on a metal pipe material 40 side substantially matches an outer diameter of the metal pipe material 40 after expansion molding (see FIG. 3B). In this state, the nozzle 31 supplies a high-pressure fluid from an internal flow path 63 to the metal pipe material 40. Examples of the high-pressure fluid include a gas.

Returning to FIG. 2, the cooling unit 7 is a mechanism that cools the die 2. By cooling the die 2, the cooling unit 7 can rapidly cool the metal pipe material 40 when the expanded metal pipe material 40 has come into contact with a molding surface of the die 2. The cooling unit 7 includes a flow path 36 that is formed inside the lower die 11 and the upper die 12 and a water circulation mechanism 37 that supplies cooling water to the flow path 36 and that circulates the cooling water.

The control unit 8 is a device that controls the entire molding device 1. The control unit 8 controls the drive mechanism 3, the holding unit 4, the heating unit 5, the fluid supply unit 6, and the cooling unit 7. The control unit 8 repeatedly performs an operation of molding the metal pipe material 40 with the die 2.

Specifically, the control unit 8 controls, for example, a timing when being transported from a transport device such as a robot arm, disposing the metal pipe material 40 between the lower die 11 and the upper die 12 in an open state. Alternatively, the control unit 8 may stand by for a worker to manually dispose the metal pipe material 40 between the lower die 11 and the upper die 12. In addition, the control unit 8 controls an actuator or the like of the holding unit 4 such that the metal pipe material 40 is supported by the lower electrodes 26 on both sides in the extending direction and then the upper electrodes 27 are lowered to sandwich the metal pipe material 40. In addition, the control unit 8 controls the heating unit 5 to energize and heat the metal pipe material 40. Accordingly, a current in an axial direction flows through the metal pipe material 40, and an electric resistance of the metal pipe material 40 itself causes the metal pipe material 40 itself to generate heat due to Joule heat.

The control unit 8 controls the drive mechanism 3 to lower the upper die 12 and to bring the upper die 12 close to the lower die 11, closing the die 2. Meanwhile, the control unit 8 controls the fluid supply unit 6 to seal the opening portions of both ends of the metal pipe material 40 and to supply a fluid with the nozzle 31. Accordingly, the metal pipe material 40 softened by heating expands and comes into contact with the molding surface of the die 2. Then, the metal pipe material 40 is molded to follow the shape of the molding surface of the die 2. When the metal pipe material 40 comes into contact with the molding surface, quenching of the metal pipe material 40 is performed by being rapidly cooled with the die 2 cooled by the cooling unit 7.

Figure 4A:
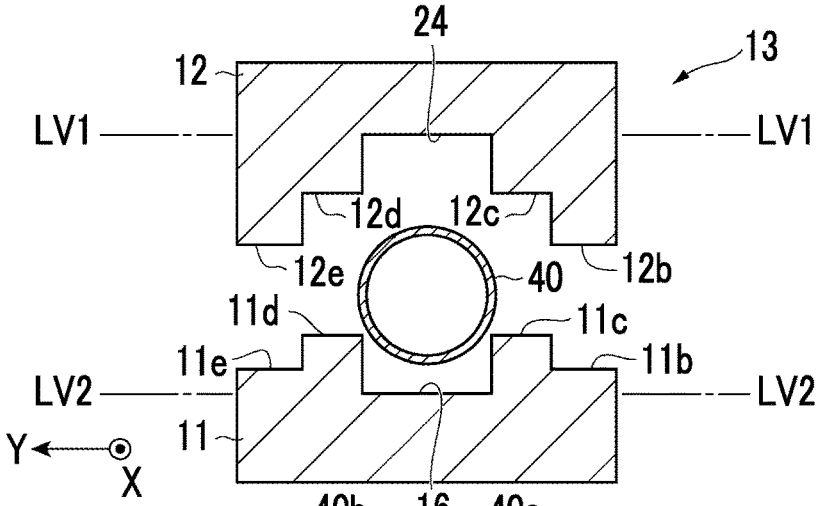
FIGS. 4A to 4D are sectional view showing states of a die during die closing.
Figure 4B:
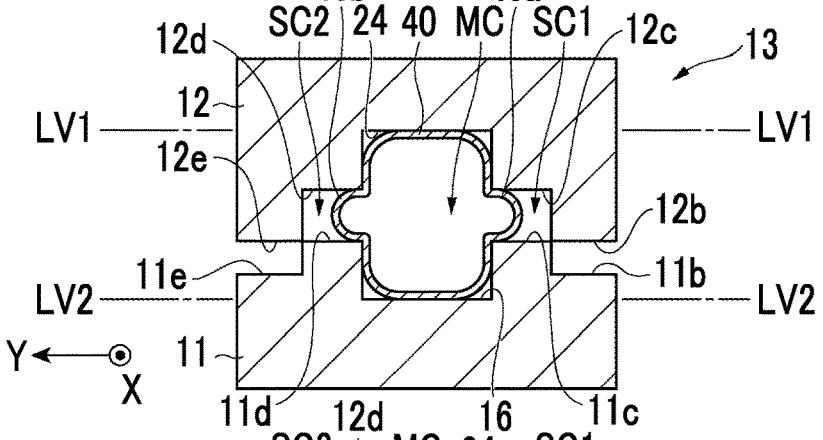

Next, the load receiving mechanism 70 will be described in detail with reference to FIGS. 4A to 5C. The load receiving mechanism 70 receives a load in the middle of a die closing operation of the die 2. Therefore, an operation of the die 2 will be described first with reference to FIGS. 4A to 4D. FIG. 4A to 4D are sectional views showing states of the die 2 during die closing. As shown in FIG. 4A, when a bottom surface of a cavity 16 at the center of the lower die 11 is defined as a reference line LV2, steps are formed on an upper surface of the lower die 11 by a first protrusion 11*b*, a second protrusion 11*c*, a third protrusion 11*d*, and a fourth protrusion 11*e*. The cavity 16 is formed between the protrusions 11*c* and 11*d* separated apart from each other in the Y-axis direction. When a bottom surface of a cavity 24 at the center of the upper die 12 is defined as a reference line LV1, steps are formed on a lower surface of the upper die 12 by a first protrusion 12*b*, a second protrusion 12*c*, a third protrusion 12*d*, and a fourth protrusion 12*e*. The cavity 24 is formed between the protrusion 12*c* and 12*d* separated apart from each other in the Y-axis direction.

First, in a case of heating the metal pipe material 40, the heating and expanding unit 50 dispose the metal pipe material 40 between the lower die 11 and the upper die 12. In this case, the slide 21 moves from a die closing start position (a so-called top dead center, a position shown in FIG. 1) to the lower side and moves the upper die 12 to a position on a near side of the metal pipe material 40 as shown in FIG. 4A. In the state shown in FIG. 4A, the metal pipe material 40 is heated. Next, the upper die 12 moves to a position shown in FIG. 4B. In this case, a main cavity portion MC is formed between the bottom surface (a surface serving as the reference line LV1) of the cavity 24 of the upper die 12 and the bottom surface (a surface serving as the reference line LV2) of the cavity 16 of the lower die 11. In addition, sub-cavity portions SC1 and SC2 that communicate with the main cavity portion MC and that have a volume smaller than that of the main cavity portion MC is formed between the protrusion 12*c* and 12*d* of the upper die 12 and the protrusions 11*c* and 11*d* of the lower die 11. The main cavity portion MC is a portion that molds a pipe portion 41*a* (see FIG. 4D) in a metal pipe 41, and the sub-cavity portions SC1 and SC2 are portions that mold flange portions 41*b* and 41*c* respectively in the metal pipe 41 (see FIG. 4C). In a state where the upper die 12 is at a position shown in FIG. 4B, a fluid is supplied to the metal pipe material 40 at a low pressure (primary blow). Accordingly, a part of the metal pipe material 40 enters the sub-cavity portions SC1 and SC2 and becomes planned flange portions 40*a* and 40*b*. In addition, the metal pipe material 40 has a shape corresponding to the main cavity portion MC. A position of the upper die 12 where primary blow is performed as described above is called an intermediate position in some cases.

Figure 4C:
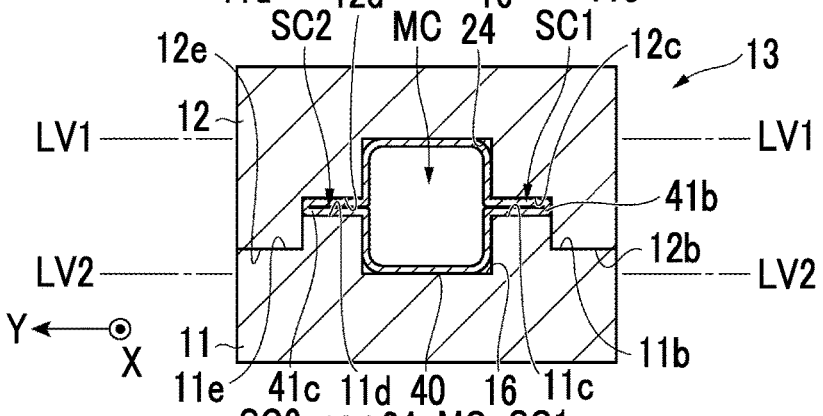
Figure 4D:
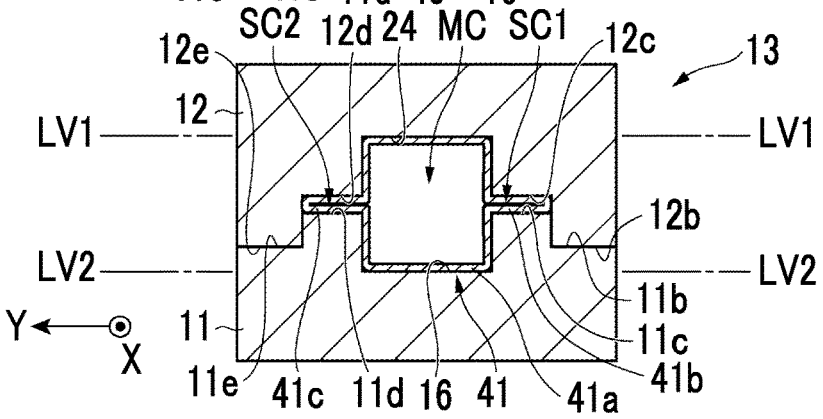

Next, once primary blow is completed, the upper die 12 moves further to the lower side and is joined to the lower die 11, coming into a completely closed state as shown in FIG. 4C. The position is called a die closing completion position (a so-called bottom dead center) in some cases. The intermediate position of FIG. 4B can be said to be a position before the completion position since the die 2 is not completely closed and die closing is not completed. When the upper die 12 reaches the completion position, the planned flange portions 40*a* and 40*b* are completely crushed and are formed as the flange portions 41*b* and 41*c*. Next, a fluid is supplied to the metal pipe material 40 at a high pressure (secondary blow). Accordingly, as shown in FIG. 4D, the pipe portion 41*a* of the metal pipe 41 has a shape corresponding to the main cavity portion MC. After then, the upper die 12 moves to the upper side and returns to the die closing start position (see FIG. 1). With this, the metal pipe 41 is completed.

Figure 5A:
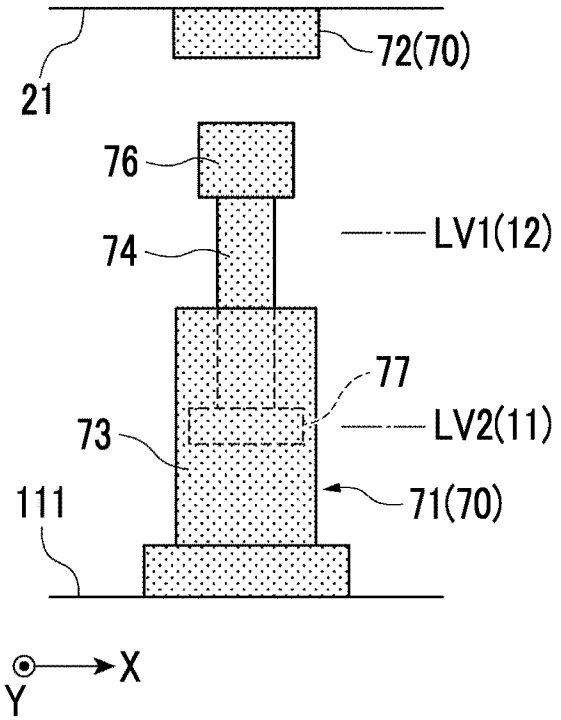
FIG. 5A to 5C are views showing an operation of a load receiving mechanism.
Figure 5B:
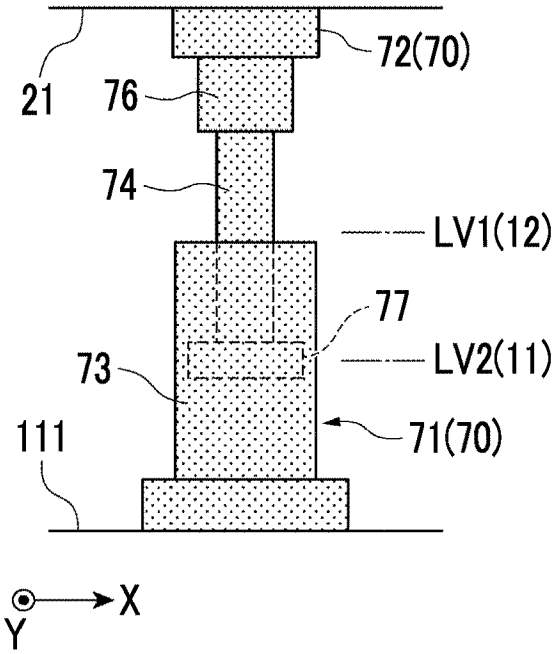
Figure 5C:
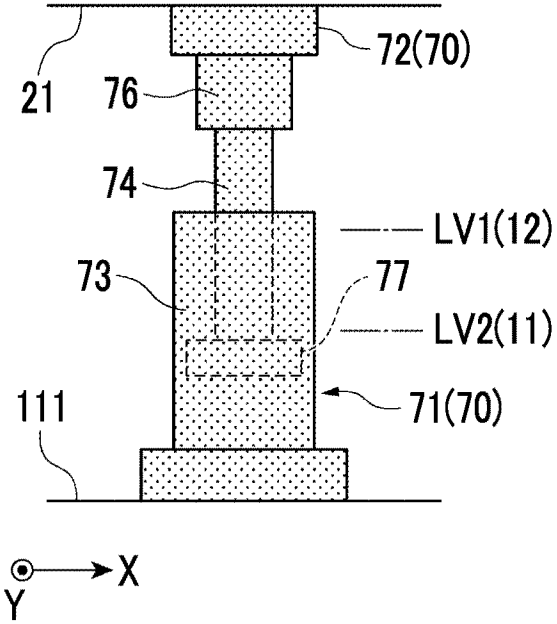

Next, a configuration and an operation of the load receiving mechanism 70 will be described with reference to FIGS. 5A to 5C. FIG. 5A is a view showing a state of the load receiving mechanism 70 during energization and heating of the metal pipe material 40 of FIG. 4A. FIG. 5B is a view showing a state of the load receiving mechanism 70 during primary blow of FIG. 4B. FIG. 5C is a view showing a state of the load receiving mechanism 70 during secondary blow at the die closing completion position of FIG. 4D. FIGS. 5A to 5C show the reference lines LV1 and LV2 shown in FIG. 4A to 4D.

As shown in FIG. 5A, the load receiving member 71 is configured by a hydraulic cylinder. The load receiving member 71 includes a cylinder portion 73, a rod portion 74, and a load receiving portion 76. The cylinder portion 73 is a tubular member that has a lower end portion fixed to the base stage 111 and that extends upward. The rod portion 74 is a member that is inserted into the cylinder portion 73 to be capable of advancing and retreating and that extends upward from an upper end portion of the cylinder portion 73. A piston portion 77 that is provided inside the cylinder portion 73 is provided at a lower end portion of the rod portion 74. The piston portion 77 is in a state where a pressure is applied from below by a hydraulic pressure. The load receiving portion 76 is provided at an upper end portion of the rod portion 74. The load receiving portion 76 is a portion that receives a load from the slide 21 via the contact member 72 by coming into contact with the contact member 72. The load receiving member 71 is not limited to the hydraulic cylinder and may be an elastic body such as a gas cylinder and a belleville spring.

The load receiving mechanism 70 is a mechanism that receives a load to stop the die closing operation during die closing of the upper die 12 and the lower die 11. The load receiving mechanism 70 stops the die closing operation at a position before the die closing completion position. In the present embodiment, the load receiving member 71 receives a load from the slide 21 via the contact member 72 by coming into contact with the contact member 72 (see FIG. 5B). Accordingly, the load receiving member 71 stops the die closing operation of the die 2 by temporarily stopping the movement of the upper die 12 together with the slide 21. The load receiving member 71 stops the slide 21 and the upper die 12 at a position (a position shown in FIG. 4B) when performing primary blow before the completion position. For this reason, a protruding amount of the rod portion 74 is set in advance such that the contact member 72 and the load receiving portion 76 come into contact with each other at the intermediate position.

A pressure with respect to the piston portion 77 is set as a first pressure that is a pressure at which movement of the slide 21 is stopped without moving when a load from the slide 21 is received via the contact member 72. That is, the load receiving member 71 can stop the die closing operation at the first pressure before reaching the die closing completion position. Accordingly, primary blow (first fluid supply) to the metal pipe material 40 is performed in a state where the load receiving mechanism 70 has stopped the die closing operation. The load receiving member 71 can freely adjust the first pressure according to a device, a molding product, or the like.

Once primary blow is completed, the slide 21 tends to move to the lower side at a higher pressure. Accordingly, in a case where a pressure higher than the first pressure is applied, the load receiving member 71 allows the die closing operation. That is, as the piston portion 77 pushes back the hydraulic pressure inside the cylinder portion 73, the rod portion 74 sinks toward the inside of the cylinder portion 73. Accordingly, the slide 21 moves downward together with the upper die 12. Accordingly, the upper die 12 is allowed to move to the completion position (see FIG. 5C). Accordingly, secondary blow (second fluid supply) to the metal pipe material 40 is performed in a state where the upper die 12 has reached the completion position.

An operation of the load receiving mechanism 70 from energization and heating to secondary blow will be described. First, during energization and heating (state of FIG. 4A), as shown in FIG. 5A, the contact member 72 is disposed at a position separated apart from the load receiving portion 76 of the load receiving member 71 to the upper side. When energization and heating are completed and the slide 21 moves to the lower side, as shown in FIG. 5B, the contact member 72 comes into contact with the load receiving portion 76 of the load receiving member 71. Accordingly, the load receiving member 71 receives a load of the slide 21, stops movement of the slide 21, and stops the die closing operation of the upper die 12. Accordingly, the upper die 12 can be stopped at the intermediate position (see FIG. 4B). When primary blow is completed, the slide 21 tends to move to the lower side at a high pressure for mold clamping. Accordingly, a pressure higher than the first pressure is applied to the load receiving member 71, and the piston portion 77, the rod portion 74, and the load receiving portion 76 sink to the lower side. Therefore, the lower die 11 moves to the die closing completion position together with the slide 21 (see FIG. 4C). When secondary blow to the metal pipe material 40 is completed, the slide 21 returns to the die closing start position (see FIG. 1). The load receiving member 71 applies a pressure to the piston portion 77 and returns to the state of FIG. 5A.

Herein, the molding device 1 described above may be directly manufactured from a time of manufacturing of the device. However, the molding device may be manufactured by making modification of adding a component to an existing press device existed already. That is, the molding device 1 that can perform expansion molding of the metal pipe material 40 having a closed section may be manufactured by adding the load receiving mechanism 70 that receives a load to stop the die closing operation during die closing to the existing press device.

Figure 6:
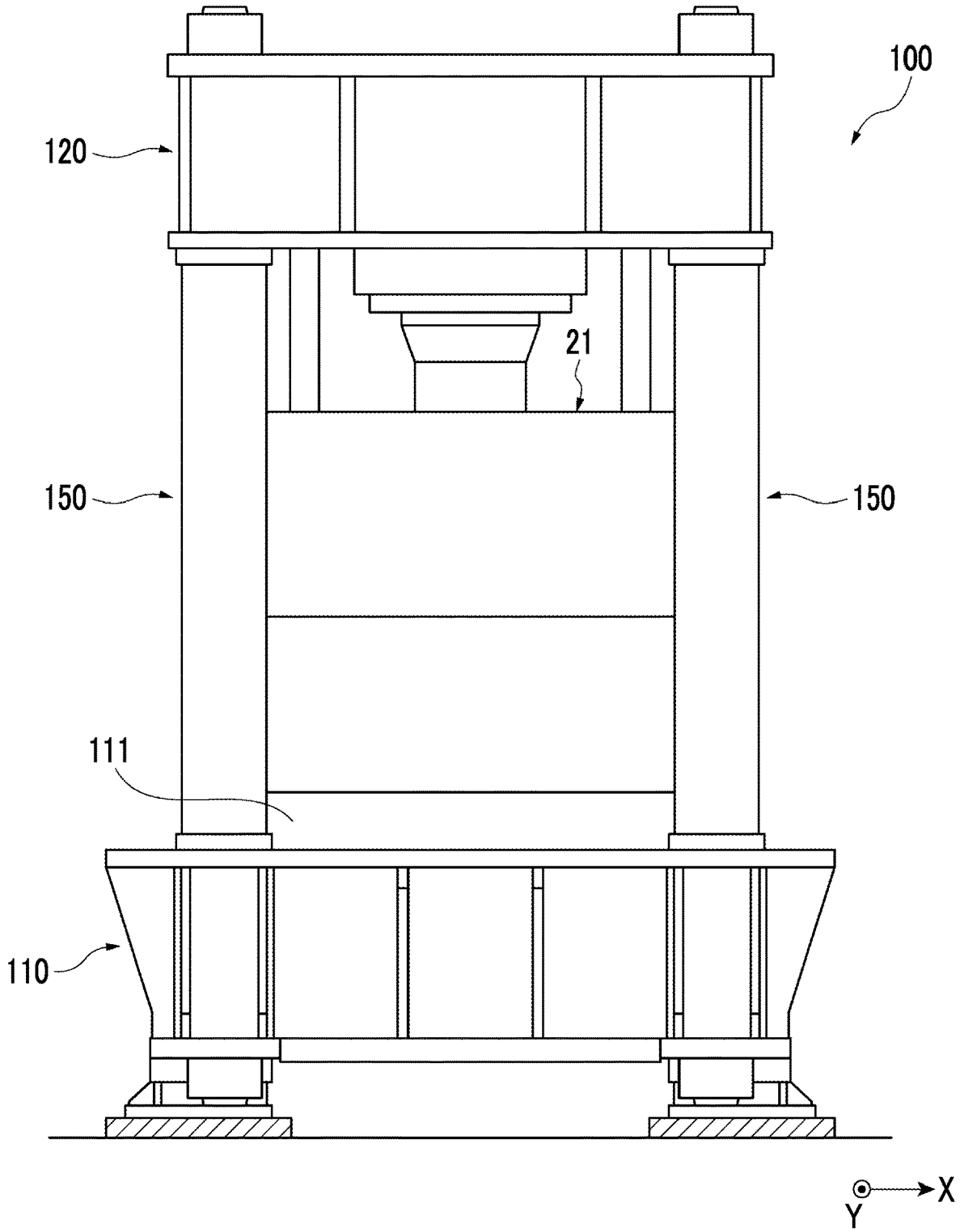
FIG. 6 is a front view of an existing press device that is a basis for manufacturing the molding device shown in FIG. 1.
Figure 7:
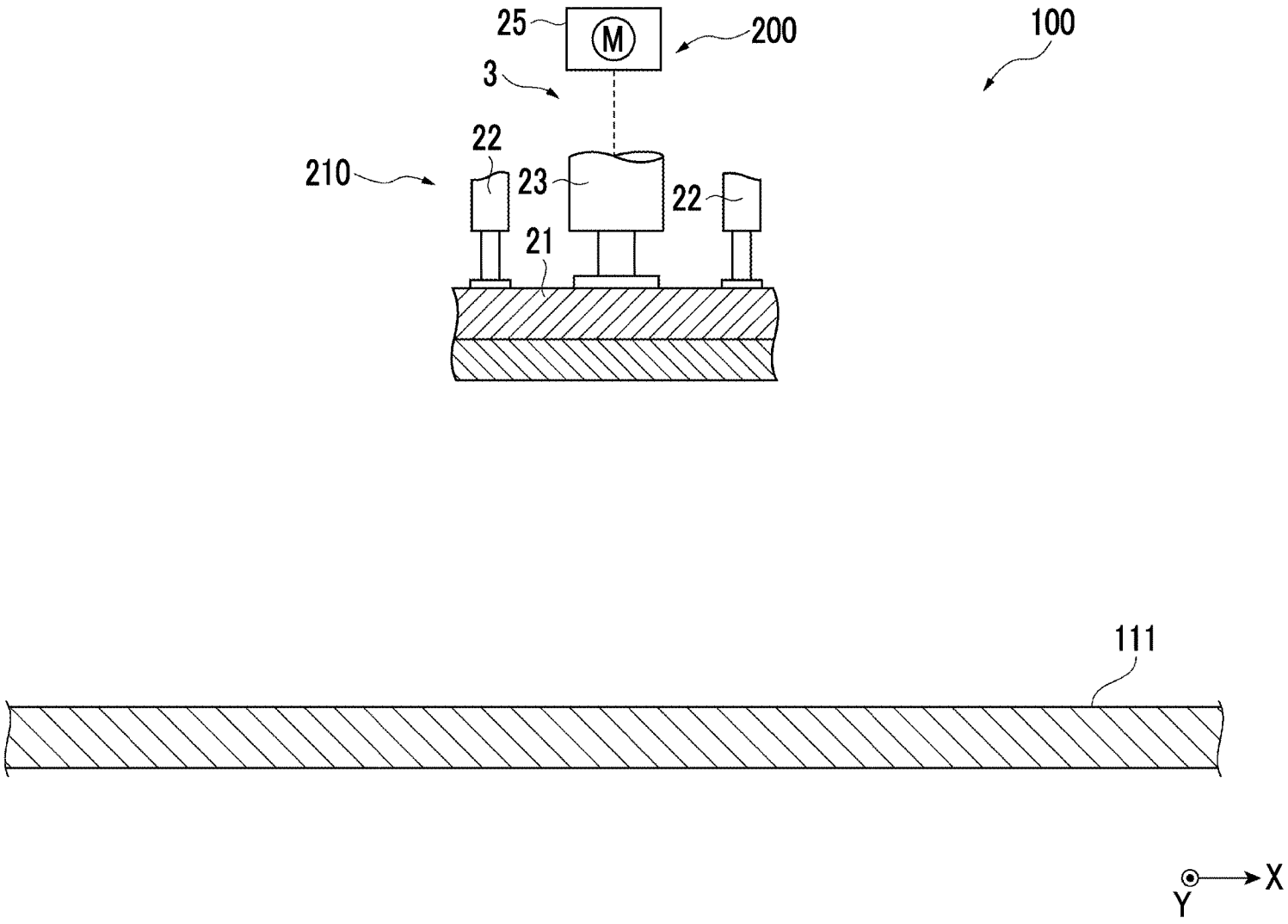
FIG. 7 is a schematic view of the existing press device that is the basis for manufacturing the molding device shown in FIG. 2.

FIGS. 6 and 7 are views showing an existing press device 100 that is a basis for manufacturing the molding device 1 shown in FIGS. 1 and 2 described above. The existing press device 100 is a molding device in a preliminary stage of assembling components peculiar to a molding device for hot expansion molding. That is, FIG. 6 shows the existing press device 100 that is a device obtained by removing the components peculiar to the molding device for hot expansion molding from the molding device 1 shown in FIG. 1. In addition, FIG. 7 shows the existing press device 100 that is a device obtained by removing the components peculiar to the molding device for hot expansion molding from the molding device 1 shown in FIG. 2. Specifically, as shown in FIGS. 6 and 7, the existing press device 100 is a device obtained by removing at least the load receiving mechanism 70, the holding unit 4, the heating unit 5, the fluid supply unit 6, and the cooling unit 7 from the molding device 1. The existing press device 100 includes the slide 21 and the base stage 111 that are the disposition portions for disposing the upper die 12 and the lower die 11. In addition, the existing press device 100 has the lower base portion 110, the upper base portion 120, the drive mechanism 3, and the pillar portions 150. For example, the existing press device 100 corresponds to a molding device or the like such as a hydraulic press.

The molding device 1 that is shown in FIGS. 1 and 2 and that can perform expansion molding can be manufactured by adding the load receiving mechanism 70, the die 2, the holding unit 4, the heating unit 5, the fluid supply unit 6, the cooling unit 7, and the control unit 8 to such an existing press device 100. Accordingly, the molding device 1 can utilize a frame or the like of the existing press device 100 and can also utilize the drive mechanism 3.

As described above, the molding device 1 configures a device that utilizes a part of the members of the existing press device 100 and that supplies a fluid to perform expansion molding of a metal material. Herein, the molding device 1 utilizes the frame or the like of the existing press device 100 as a part of the members. In addition, the molding device 1 utilizes the drive mechanism 3 including a hydraulic pressure control portion and a machine portion in the existing press device 100, as a part of the members of the existing press device 100. The molding device 1 may utilize only a hydraulic unit 200 configuring the hydraulic pressure control portion of the drive mechanism 3. Alternatively, the molding device 1 may utilize at least one press component 210 of a main cylinder, a bed, a crown, and a slide.

Next, operations and effects of the molding device 1, a manufacturing method of the molding device 1, and the load receiving member 71 according to the present embodiment will be described.

Herein, the metal pipe material having a closed section is required to be molded in some cases. Further, when molding such a metal pipe material, it is also required to temporarily stop the die closing operation at a position before the die closing completion position in a case of performing expansion a plurality of times or the like. However, it is difficult to accurately stop the die closing operation at the position before the die closing completion position depending on a drive mechanism of the molding device in some cases. Therefore, the die is required to accurately stop at a desired position during die closing.

According to the embodiment of the present disclosure, it is desirable to provide a molding device, a manufacturing method of a molding device, and a load receiving member that can accurately stop the die at a desired position during die closing.

The molding device 1 includes the load receiving mechanism 70 that receives a load to stop the die closing operation during die closing of the upper die 12 and the lower die 11. The load receiving mechanism 70 stops the die closing operation at the intermediate position before the die closing completion position. For this reason, a load is received by the load receiving mechanism 70 in the preliminary stage where the upper die 12 reaches the die closing completion position when die closing is being performed. The load receiving mechanism 70 is not controlled by the drive mechanism 3 or the like and can directly receive a load to perform operation stop with respect to an actual die closing operation. From the above, the die can be accurately stopped at a desired position during die closing. In addition, since a part of the members of the existing press device 100 can be utilized in the molding device 1, introduction costs of the molding device 1 can be reduced.

In a case of performing expansion molding of the metal pipe material 40, primary blow (first fluid supply) to the metal pipe material 40 may be performed in a state where the load receiving mechanism 70 has stopped the die closing operation, and secondary blow (second fluid supply) to the metal pipe material 40 may be performed in a state where the completion position is reached. In this case, in a state where the upper die 12 is accurately stopped at a desired position by the load receiving mechanism 70, primary blow to the metal pipe material 40 can be performed.

The load receiving mechanism 70 includes the load receiving member 71 configured by a hydraulic cylinder provided at a position on a lower die 11 side in a facing direction. Since the hydraulic cylinder can generate a large pressure, the load receiving mechanism 70 can generate a sufficient pressure for receiving a load of the die closing operation.

The manufacturing method of the molding device 1 is for manufacturing the molding device 1 that can perform expansion molding of the metal pipe material 40 having a closed section, by adding the load receiving mechanism 70 that receives a load to stop the die closing operation during die closing by the slide 21 to the existing press device 100 that includes the slide 21 and the base stage 111 for disposing the upper die 12 and the lower die 11, which face each other.

In the manufacturing method of the molding device 1, expansion molding of the metal pipe material 40 having a closed section can be performed by adding the load receiving mechanism 70 to the existing press device 100. Accordingly, simply by adding the load receiving mechanism 70, even the existing press device 100 that cannot perform expansion molding can easily perform expansion molding while utilizing an existing structure. In addition, the load receiving mechanism 70 can accurately stop the upper die 12 at a desired position. From the above, the die can be accurately stopped at the desired position during die closing. In addition, since a part of the members of the existing press device 100 can be utilized in the manufacturing method of the molding device 1, introduction costs of the molding device 1 can be reduced.

The load receiving member 71 is the load receiving member 71 that receives a load to stop the die closing operation during die closing of the upper die 12 and the lower die 11 of the molding device 1, stops the die closing operation at the first pressure before reaching the die closing completion position, and allows the die closing operation in a case where a pressure higher than the first pressure is applied.

In a case where the load receiving member 71 is incorporated into the molding device 1, a load is received by the load receiving member 71 in the preliminary stage where the upper die 12 and the lower die 11 reach the die closing completion position when die closing is being performed. Since the load receiving member 71 is not controlled by the drive mechanism 3 or the like and can directly receive a load to perform operation stop with respect to the actual die closing operation, the upper die 12 can be accurately stopped at a desired position. Then, once a pressure higher than the first pressure is applied, the upper die 12 can reach the completion position as the load receiving member 71 restarts the die closing operation. From the above, the die can be accurately stopped at the desired position during die closing. In addition, since a part of the members of the existing press device 100 can be utilized by using the load receiving member 71, introduction costs of the molding device 1 can be reduced.

The molding device 1 according to the present embodiment supplies a fluid and performs expansion molding of a metal material using at least a part of the members of the existing press device 100.

According to this, the molding device 1 that supplies a fluid and performs expansion molding of a metal material can be configured by utilizing a part of the members of the existing press device 100. Accordingly, introduction costs of the molding device 1 can be reduced.

The fluid may be a gas.

The molding device 1 may perform expansion molding of a heated metal material.

A part of the members may be the hydraulic unit 200. In this case, the hydraulic unit 200 of the existing press device 100 may be utilized, and the machine portion may be updated. For example, physical dimensional requirements of the existing press device 100 required for the molding device 1 are not satisfied, but this utilization mode is adoptable when the hydraulic unit 200 has a control function of the molding device 1. Accordingly, investment in the hydraulic unit 200 portion of the molding device 1 can be suppressed.

A part of the members may be at least one press component 210 of a main cylinder, a bed, a crown, and a slide. In this case, the machine portion of the existing press device 100 may be utilized, and the hydraulic pressure control portion or the like may be updated. Although the physical dimensional requirements of the existing press device 100 required for the molding device 1 are satisfied, this utilization mode is adoptable when the hydraulic pressure cannot be controlled. Accordingly, investment in the machine portion of the molding device 1 can be suppressed.

A molding device according to an aspect of the present disclosure is a molding device that molds a metal pipe material having a closed section, includes a first die and a second die, which face each other, and a load receiving mechanism that receives a load to stop a die closing operation during die closing of the first die of the second die, in which the load receiving mechanism stops the die closing operation at a position before a die closing completion position.

The molding device includes the load receiving mechanism that receives a load to stop the die closing operation during die closing of the first die and the second die. The load receiving mechanism stops the die closing operation at a position before the die closing completion position. For this reason, a load is received by the load receiving mechanism in the preliminary stage where the first die and the second die reach the die closing completion position when die closing is being performed. The load receiving mechanism is not controlled by the drive mechanism or the like and can directly receive a load to perform operation stop with respect to the actual die closing operation. From the above, the die can be accurately stopped at the desired position during die closing. In addition, since a part of the members of the existing press device can be utilized in the molding device, introduction costs of the molding device can be reduced.

In a case of performing expansion molding of the metal pipe material, first fluid supply to the metal pipe material may be performed in a state where the load receiving mechanism has stopped the die closing operation, and second fluid supply to the metal pipe material may be performed in a state where the completion position is reached. In this case, in a state where the die is accurately stopped at a desired position by the load receiving mechanism, first fluid supply to the metal pipe material can be performed.

The load receiving mechanism includes the hydraulic cylinder provided at a position on at least one side of the first die and the second die in the facing direction. Since the hydraulic cylinder can generate a large pressure, the load receiving mechanism can generate a sufficient pressure for receiving a load of the die closing operation.

A manufacturing method of a molding device according to another aspect of the present disclosure includes manufacturing a molding device that can perform expansion molding of a metal pipe material having a closed section by adding a load receiving mechanism that receives a load to stop a die closing operation during die closing by a disposition portion to an existing press device that includes the disposition portion for disposing a first die and a second die, which face each other.

In the manufacturing method of a molding device, expansion molding of the metal pipe material having a closed section can be performed by adding the load receiving mechanism to the existing press device. Accordingly, simply by adding the load receiving mechanism, even the existing press device that cannot perform expansion molding can easily perform expansion molding while utilizing an existing structure. In addition, the load receiving mechanism can accurately stop the die at a desired position. From the above, the die can be accurately stopped at the desired position during die closing. In addition, since a part of the members of the existing press device can be utilized in the manufacturing method of a molding device, introduction costs of the molding device can be reduced.

A load receiving member according to still another aspect of the present disclosure is a load receiving member that receives a load to stop a die closing operation during die closing of a first die and a second die of a molding device, that stops the die closing operation at a first pressure before reaching a die closing completion position, and allows the die closing operation in a case where a pressure higher than the first pressure is applied.

In a case where the load receiving member is incorporated into the molding device, a load is received by the load receiving member in the preliminary stage where the first die and the second die reach the die closing completion position when die closing is being performed. Since the load receiving member 71 is not controlled by the drive mechanism or the like and can directly receive a load to perform operation stop with respect to the actual die closing operation, the die can be accurately stopped at a desired position. Then, once a pressure higher than the first pressure is applied, the die can reach the completion position as the load receiving member restarts the die closing operation. From the above, the die can be accurately stopped at the desired position during die closing. In addition, since a part of the members of the existing press device can be utilized by using the load receiving member, introduction costs of the molding device can be reduced.

The present disclosure is not limited to the embodiment described above.

The load receiving member 71 is provided with respect to the base stage 111 and the slide 21, but may be disposed anywhere insofar as a load associated with die closing can be received. In addition, the load receiving member 71 is provided on the lower die 11 side, but may be provided on an upper die 12 side. Further, the load receiving members 71 may be provided on both the upper die 12 side and the lower die 11 side.

Figure 8:
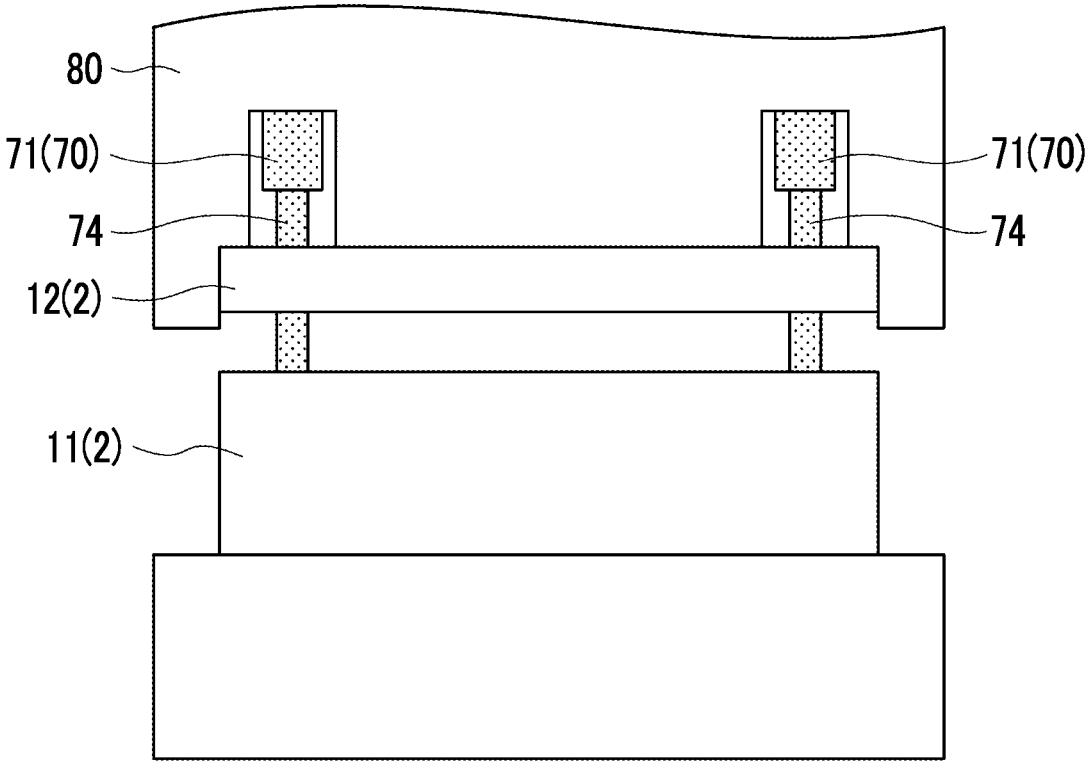
FIG. 8 is a schematic view showing a molding device according to a modification example.

For example, as shown in FIG. 8, the load receiving member 71 may be provided at a position of the die 2 and may directly receive a load of the die 2. In this case, the load receiving member 71 is preferably provided at a position that does not interfere with a molding product. For example, the load receiving member 71 may be provided between the upper die 12 and a die holder 80. In this case, the rod portion 74 may penetrate the upper die 12 and may receive a load by coming into contact with the lower die 11.

A position where the load receiving member 71 stops the die closing operation may not be a position of primary blow or may be any stop position insofar as the position is between the die closing start position and the die closing completion position.

In the embodiment described above, the molding device for hot expansion molding has been described as an example. However, a type of the molding device in which the load receiving member according to the present disclosure is adopted is not particularly limited, and may be any type of the molding device that molds the metal pipe material having a closed section.

A die stop position may be adjusted by adjusting the thickness or the length of each component of the load receiving mechanism 70. For example, the thickness of the contact member 72, and the length of the load receiving portion 76, and the provision height of the base stage 111 may be manually adjusted. The adjustment is performed in a case of changing the type of the metal pipe or the length and the thickness of the flange portion. The die stop position may be adjusted by providing an actuator that automatically adjusts the dimension of the load receiving mechanism 70 in the up-down direction.

In addition, a part of the members from the existing press device 100 utilized by the molding device 1 is not limited to the embodiment described above.

Figure 9:
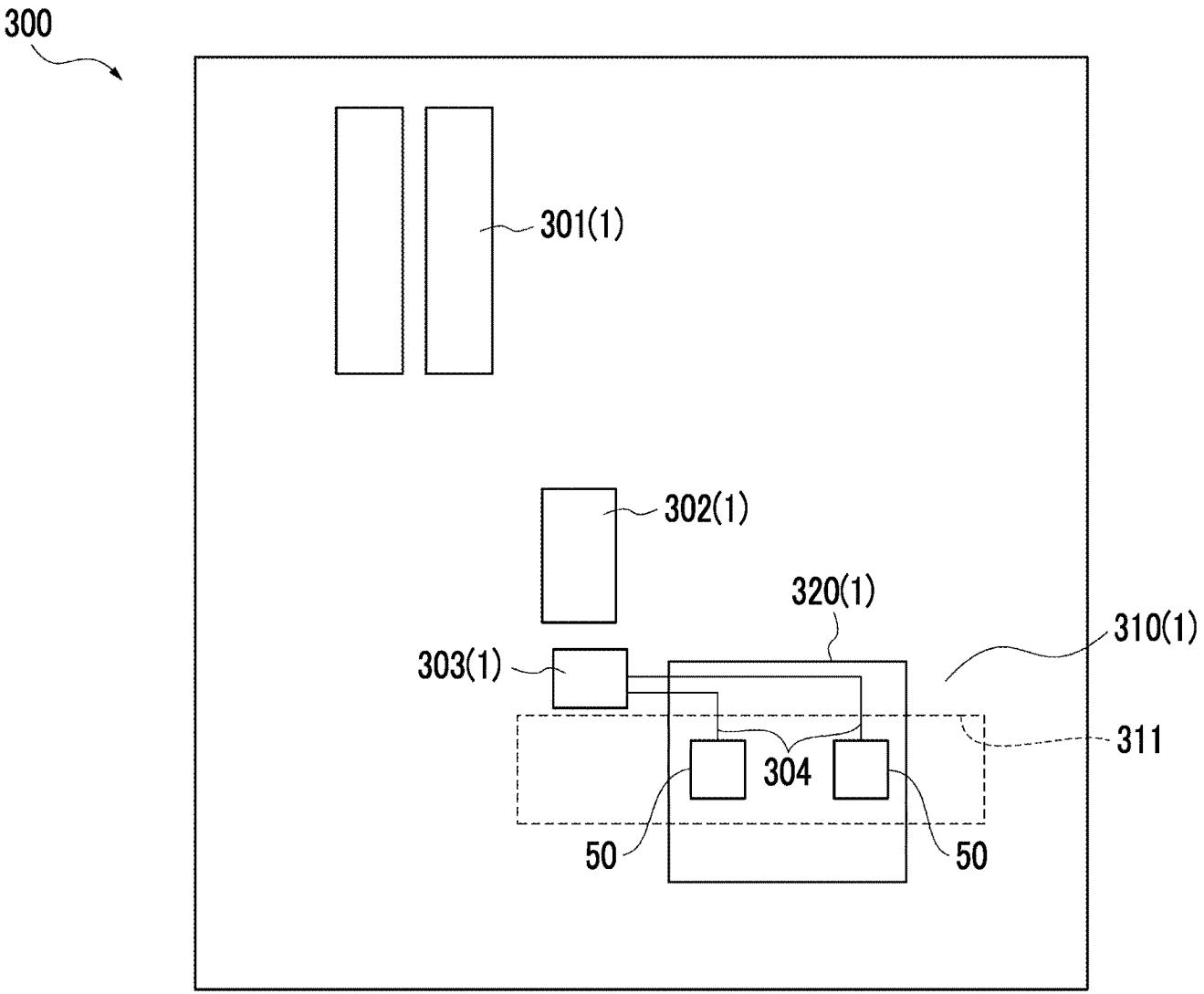
FIG. 9 is a schematic plan view showing an entire building of the molding device.

FIG. 9 is a schematic plan view showing an entire building 300 for the molding device 1. The molding device 1 includes a main body 320 (a portion shown in FIGS. 1 and 2) that includes the heating and expanding unit 50 or a die, a high-pressure air generating device 301, a control unit 302, a transformer unit 303, a busbar 304, and a foundation 310. The high-pressure air generating device 301 supplies high-pressure air to the heating and expanding unit 50 of the main body 320. The control unit 302 is a unit that controls the molding device 1. The transformer unit 303 supplies power to the heating and expanding unit 50 via the busbar 304.

Figure 11:
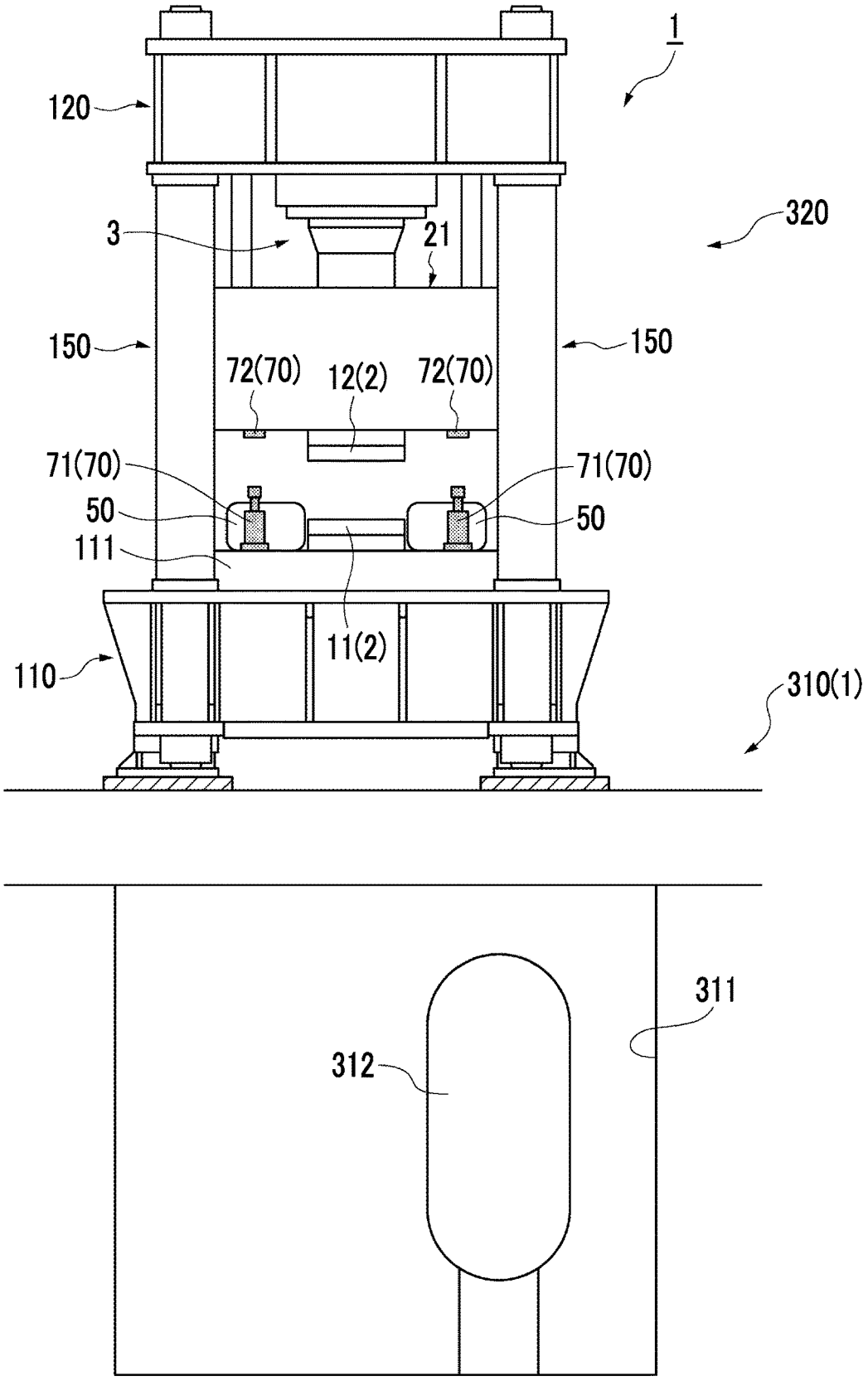
FIG. 11 is a view showing a foundation of the molding device.

The main body 320, the high-pressure air generating device 301, the control unit 302, the transformer unit 303, and the busbar 304 are provided on the foundation 310 of the building 300. As shown in FIG. 11, the foundation 310 includes a basement 311 on the lower side of the main body 320. An exhaust tank 312 that stores an exhaust gas exhausted from the main body 320 is provided in the basement 311.

Figure 10:
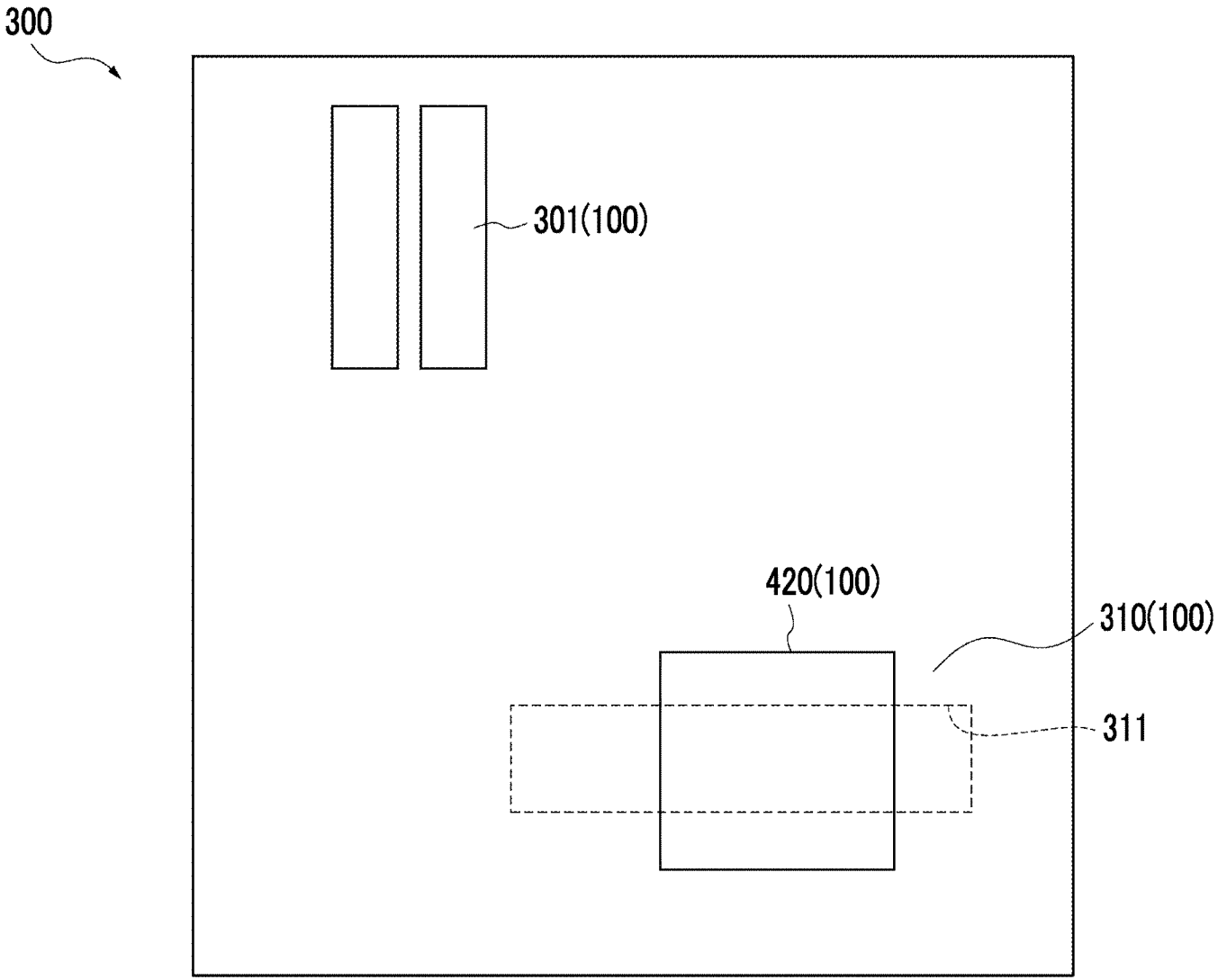
FIG. 10 is a schematic plan view showing the entire building when the existing press device is provided.
Figure 12:
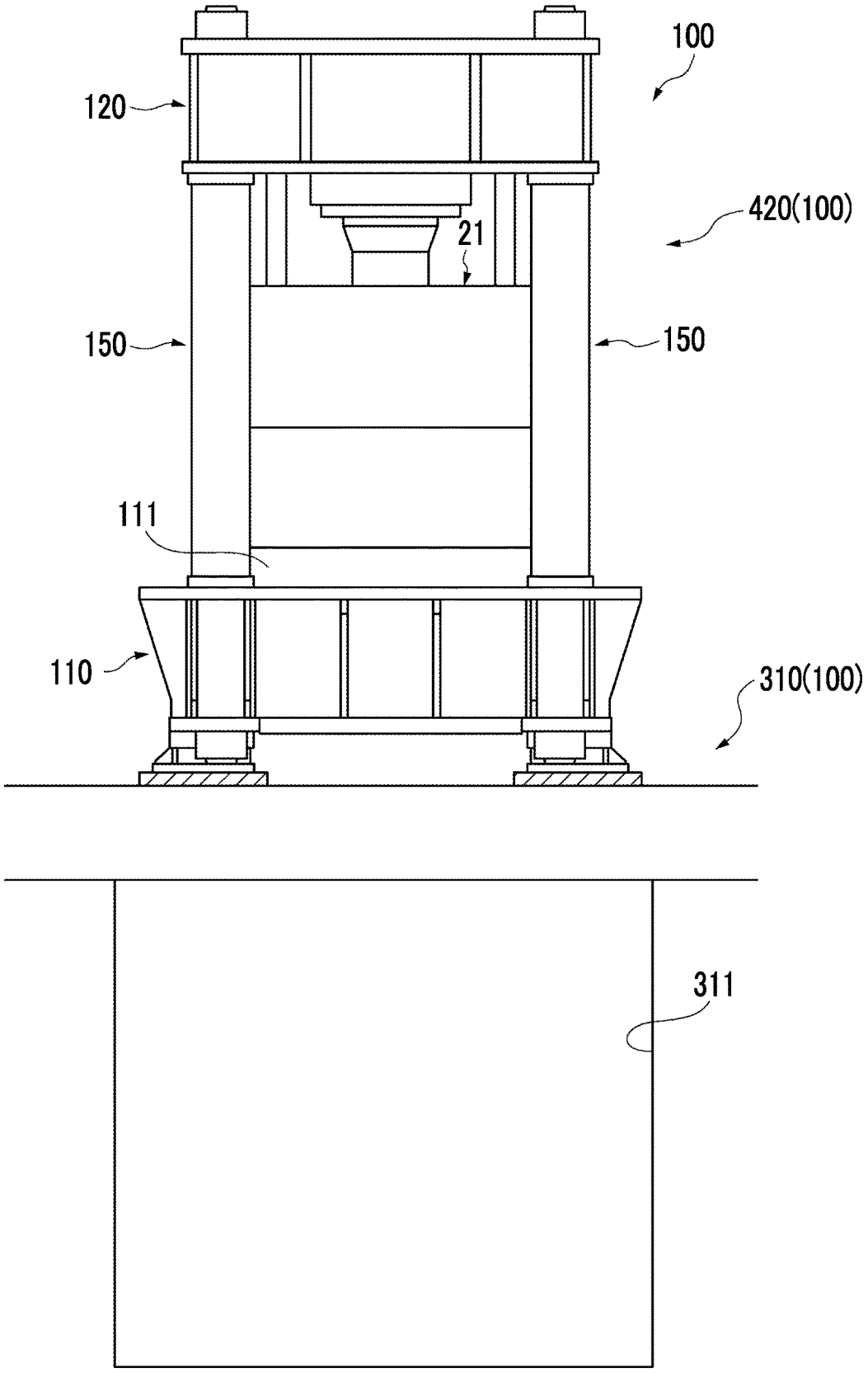
FIG. 12 is a view showing a foundation of the existing press device.

FIG. 10 is a schematic plan view showing the entire building 300 when the existing press device 100 is provided. The existing press device 100 includes, on the foundation 310, a main body 420 (a portion shown in FIG. 6) and the high-pressure air generating device 301. As shown in FIG. 12, the exhaust tank 312 is not provided in the basement 311 on the lower side of the main body 420.

The molding device 1 can utilize the foundation 310 and the high-pressure air generating device 301 as a part of the members of the existing press device 100. Specifically, the molding device 1 is configured such that the control unit 302, the transformer unit 303, the busbar 304, and the exhaust tank 312 (see FIG. 11) are provided with respect to the foundation 310 and the main body 320 is obtained by incorporating the heating and expanding unit 50 or the like into the main body 420. In this case, the control unit 302, the transformer unit 303, the busbar 304, and the exhaust tank 312, which are peripheral devices of the main body 320, are provided with the foundation 310 as reference. That is, with respect to the main body 320, the structure of the foundation 310 is utilized to provide each peripheral device. The peripheral device is not limited thereto, a laser device that cuts a metal pipe, a preform device that bends the metal pipe in advance, and the like may be provided. In addition, the position of each peripheral device is not particularly limited, and may be disposed on the ground floor or may be disposed underground. Although not shown, not only the foundation 310 and the high-pressure air generating device 301 are utilized, but also at least one press component of a main cylinder, a bed, a crown, and a slide may be utilized. In this case, since the machine portion of the existing press device can be utilized, investment in the machine portion of the molding device 1 can be suppressed.

As described above, a part of the members utilized from the existing press device 100 may be the foundation 310. In this case, costs of foundation work can be omitted by utilizing the foundation 310 of the existing press device 100.

The peripheral device in the molding device 1 may be provided with the foundation 310 as reference. In this case, layout can effectively use the foundation of the existing press device 100.

A part of the members may be the high-pressure air generating device 301. In this case, capital investment in the high-pressure air generating device 301 can be suppressed.

A part of the members may be at least one press component of a main cylinder (23), a bed (110), a crown (120), and a slide (21). In this case, the machine portion of the existing press device may be utilized, and a hydraulic pressure control portion or the like may be updated.

Aspect 1

A molding device that supplies a fluid to perform expansion molding of a metal material using at least a part of members of an existing press device.

Aspect 2

The molding device according to aspect 1, in which the fluid is a gas.

Aspect 3

The molding device according to aspect 1 or 2, in which expansion molding of a heated metal material is performed.

Aspect 4

The molding device according to any one of aspects 1 to 3, in which the part of the members is a foundation.

Aspect 5

The molding device according to aspect 5, in which a peripheral device in the molding device is provided with the foundation as reference.

Aspect 6

The molding device according to any one of aspects 1 to 5, in which the part of the members is a high-pressure air generating device.

Aspect 7

The molding device according to any one of aspects 1 to 6, in which the part of the members is a hydraulic unit.

Aspect 8

The molding device according to any one of aspects 1 to 7, in which the part of the members is at least one press component of a main cylinder, a bed, a crown, and a slide.

It should be understood that the invention is not limited to the above-described embodiment, but may be modified into various forms on the basis of the spirit of the invention. Additionally, the modifications are included in the scope of the invention.

What is claimed is:

1. A molding device configured to perform expansion molding of a metal material by supplying a fluid to the metal material and configured to be installed in an existing press device, the molding device comprising:

a first die and a second die facing each other; and a load receiver configured to receive, from a slide of the existing press device, a load to stop a die closing operation during die closing of the first die and the second die, the slide being configured to move the first die toward the second die, wherein the load receiver is configured to stop the die closing operation at a predetermined position between a die closing start position and a die closing completion position when a first pressure is applied to the load receiver, and allow the die closing operation when a second pressure higher than the first pressure is applied to the load receiver.

2. The molding device according to claim 1, wherein the fluid is a gas.

3. The molding device according to claim 1, wherein expansion molding of a heated metal material is performed.

4. The molding device according to claim 1, wherein a first driver configured to move the first die is accommodated in a crown of the existing press device, and a second driver configured to move the second die is accommodated in a bed of the existing press device.

5. The molding device according to claim 4, wherein the first die is attached to the slide via a die holder.

6. The molding device according to claim 1, wherein the load receiver includes a load receiving member provided on an upper surface of a base stage of the existing press device and a contact member provided on a lower surface of the slide, and the contact member is provided at a position facing the load receiving member on an upper side of the load receiving member.

7. The molding device according to claim 1, further comprising a holder, a heater, and a fluid supplier.

8. The molding device according to claim 7, wherein the fluid supplier includes a nozzle configured to supply a fluid from an opening portion of an end portion of the metal material to an inside of the metal material, a driver configured to move the nozzle back and forth with respect to the opening portion of the metal material, and a supply source configured to supply a high-pressure fluid into the metal material via the nozzle.

9. The molding device according to claim 7, wherein the fluid supplier is provided on both end sides of the first die and the second die in an extending direction.

* * * * *